US006053429A

United States Patent [19]

Chang

[11] Patent Number: 6,053,429

[45] Date of Patent: Apr. 25, 2000

[54] INDUSTRIAL SPRAY GUN CUP STRUCTURE

[76] Inventor: Jen-Chih Chang, No. 252, Wu Kuang Road, Wu-Jih Hsiang, Taichung Hsien, Taiwan

[21] Appl. No.: 09/328,342

[22] Filed: Jun. 9, 1999

[51] Int. Cl.[7] ..... B05B 7/30

[52] U.S. Cl. ..... 239/345; 239/346; 239/302; 239/376; 239/379; 215/325; 285/190

[58] Field of Search ..... 239/302, 345, 239/346, 376, 377, 379, 600; 215/324, 325; 220/784, 298; 285/190

[56] References Cited

U.S. PATENT DOCUMENTS

| | | | |
|---|---|---|---|
| 1,703,384 | 2/1929 | Birkenmaier | 239/379 X |
| 3,136,486 | 6/1964 | Docken | 239/302 X |
| 3,244,439 | 4/1966 | Montesi | 281/190 |
| 5,039,017 | 8/1991 | Howe | 239/346 |
| 5,372,389 | 12/1994 | Tam et al. | 285/190 X |
| 5,803,360 | 9/1998 | Spitznagel | 239/345 |
| 5,810,258 | 9/1998 | Wu | 239/346 |
| 5,918,815 | 7/1999 | Wu | 239/346 X |
| 5,984,206 | 11/1999 | Leitzel et al. | 239/345 |

*Primary Examiner*—Kevin Weldon
*Assistant Examiner*—Robin O. Evans
*Attorney, Agent, or Firm*—Rosenberg, Klein & Lee

[57] ABSTRACT

An industrial spray gun cup structure includes a connector, a guide member, a collar and a cover body. A reception section of the cup is engaged with the guide member so that the cup can be only normally rotated without rotating and loosening other parts. The cup is integrally formed with inclined ribs which are tightly fitted with corresponding connecting sections of the cover body. While rotating the cover body by a certain angle, the ribs can be separated from or inserted with the connecting sections so as to open or close the cover body. Therefore, the cover body can be conveniently rotated to firmly and tightly fit with the cup without leakage.

4 Claims, 5 Drawing Sheets

INDUSTRIAL SPRAY GUN CUP STRUCTURE

BACKGROUND OF THE INVENTION

The present invention relates to an industrial spray gun cup structure, and more particularly to an industrial spray gun cup structure which can be conveniently adjusted without loosening or leakage.

FIG. 6 shows an existing spray gun cup connector 9 composed of a guide pipe 91, a fastening nut 92, a connector 93 and a coupler 94 of a spray gun (not shown). The guide pipe 91 is formed with a flange 911. By means of rotating the fastening nut 92, the angle contained by the cup 95 and the spray gun can be adjusted.

When adjusting the angle of the spray gun, the fastening nut 92 is rotated about the flange 911 so as to change the angle of the cup 95. However, when rotating the fastening nut 92, it is necessary to hold other portions still so as to avoid rotation and loosening of other portions. This is inconvenient for a user. In the case that the user directly holds and rotate the cup 95, the other portions, such as the connection between the guide pipe 91 and the connector 93 will be rotated and loosened. This will take place even the connection is painted with a leakproof adhesive. As a result, a leakage will happen at the cup 95 or even the entire cup 95 will be tilted down.

FIG. 7 shows an existing industrial spray gun cup 95 which has a filling port 951 at the top. A cover body 96 is fitted with the top of the cup 95 for sealing the filling port 951. In use, it is necessary to frequently fill material into the cup 95 so as to avoid over-loading of the cup 95 which will affect the work. Therefore, the cover body 96 is frequently opened and closed. In the case that the cover body 96 is too loosely fitted with the cup 95, the cover body 96 tends to detach from the cup 95 or the paint material is likely to leak from the cup 95. In the case of too tight fit, it is uneasy to open the cover body 96. Therefore, it is inconvenient for a user to use the spray gun and the precision of the cover body 96 and the cup 95 must be strictly required.

In addition, the paint material containing the adhesive tends to attach to the cup 95 and the cover body 96. Once the cover body 96 is adhered to the cup 95, it will be more uneasy to pull open the cover body 96.

SUMMARY OF THE INVENTION

It is therefore a primary object of the present invention to provide an industrial spray gun cup structure in which a reception section of the cup is engaged with the guide member so that the cup can be only normally rotated without rotating and loosening other parts and thus the cup is prevented from being loosened or tilted and the leakage is avoided.

It is a further object of the present invention to provide the above industrial spray gun cup structure in which the cup is integrally formed with inclined ribs which are tightly fitted with corresponding connecting sections of the cover body. Only by means of rotating the cover body by a certain angle, the ribs can be separated from or inserted with the connecting sections so as to open or close the cover body. Therefore, the cover body can be conveniently rotated to firmly and tightly fit with the cup without leakage.

The present invention can be best understood through the following description and accompanying drawings wherein:

DETAILED DESCRIPTION OF THE PREFERRED EMBODIMENTS

Figure 1:
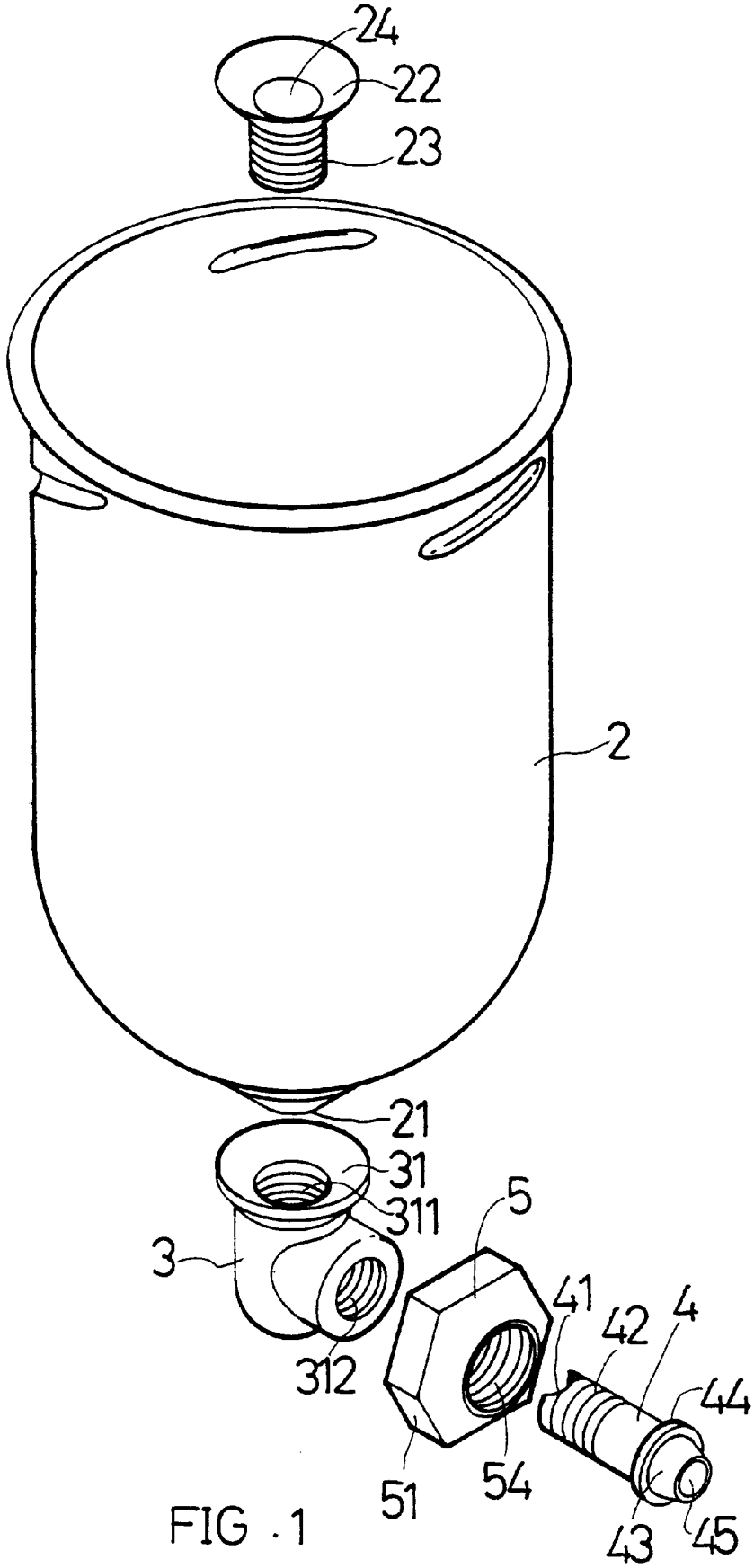
FIG. 1 is a perspective exploded view of a first embodiment of the present invention.
Figure 2:
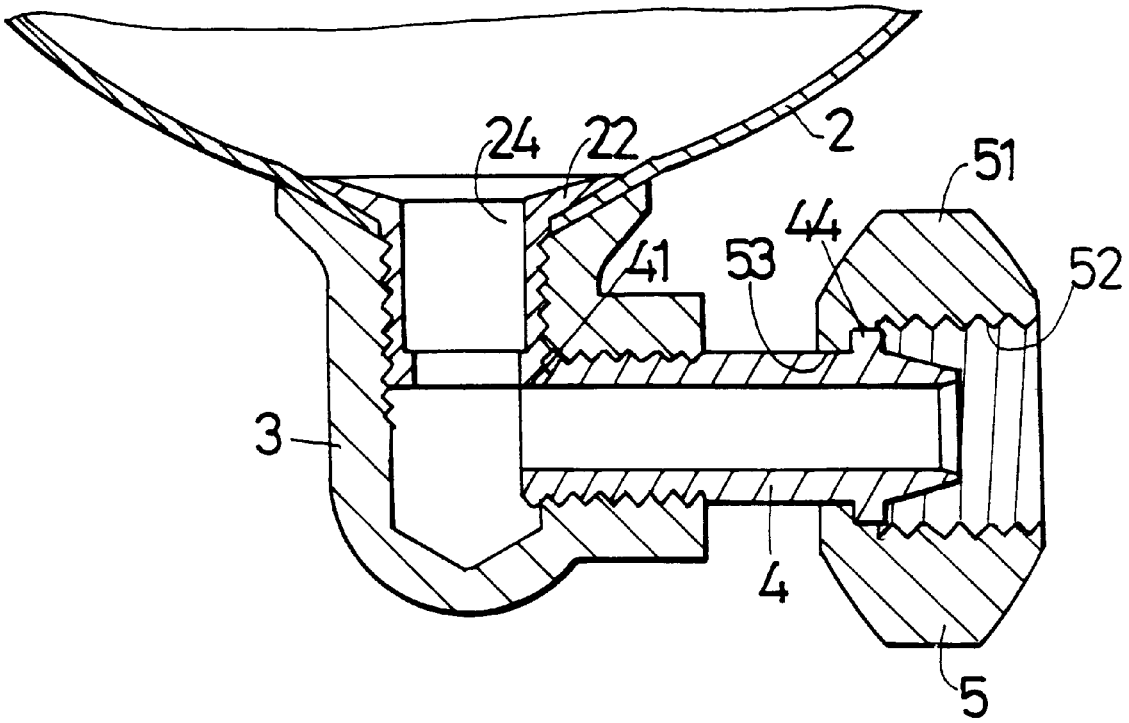
FIG. 2 is a sectional assembled view of a part of the first embodiment of the present invention.

Please refer to FIGS. 1 and 2. According to a first embodiment, the present invention includes:

a cylindrical cup 2 made by rolling to form a seamless container for containing therein a paint material, a bottom end of the cup 2 being formed with a material outlet 21 disposed with a reception section 22, one end of the reception section 22 being fixedly connected with the cup 2, while the other end thereof being formed with a thread section 23, the reception section 22 being formed with a hole 24 communicating with the interior of the cup 2;

a connector 3 formed with a hole 31 two ends of which are respectively formed with two thread sections 311, 312, the thread section 311 being screwed with the thread section 23 of the reception section 22;

a guide member 4, one end of the guide member 4 being formed with a notch 41 and a thread section 42 screwed with the other thread section 312 of the connector 3, the notch 41 of the guide member 4 abutting against the reception section 22, the other end of the guide member 4 being formed with a tapered conic section 43 having an annular flange 44, the guide member 4 being formed with a hole 45 communicating with the hole 24 of the reception section 22; and a collar 5 an outer face of which is formed with over one grip section 51, an inner wall of the collar 5 being formed with a large diameter section 52 and a small diameter section 53, the large diameter section 52 being coupled with the flange 44 of the guide member 4, the small diameter section 53 embracing the connecting section of the guide member 4 with the collar 5, the large diameter section 52 being formed with a thread section 54 screwed with a spray gun (not shown) and painted with an adhesive for avoiding leakage.

The reception section 22 is inserted into the notch 41 of the guide member 4, whereby the position of the reception section 22 relative to the guide member 4 is fixed without relative rotation. Accordingly, when a user adjusts the angle of the cup 2 via the grip section 51 of the collar 5, it is unnecessary to hold other parts with hand for avoiding rotation and loosening thereof.

In addition, in the case that the user directly holds and rotates the cup 2 in order to more conveniently and quickly adjust the angle of the cup 2, since the reception sect ion 22 is fixed with the guide member 4, the collar 5 will be the only part of the entire connector structure which is rotated. Therefore, the other parts of the connector structure are prevented from being rotated and loosened.

Figure 3:
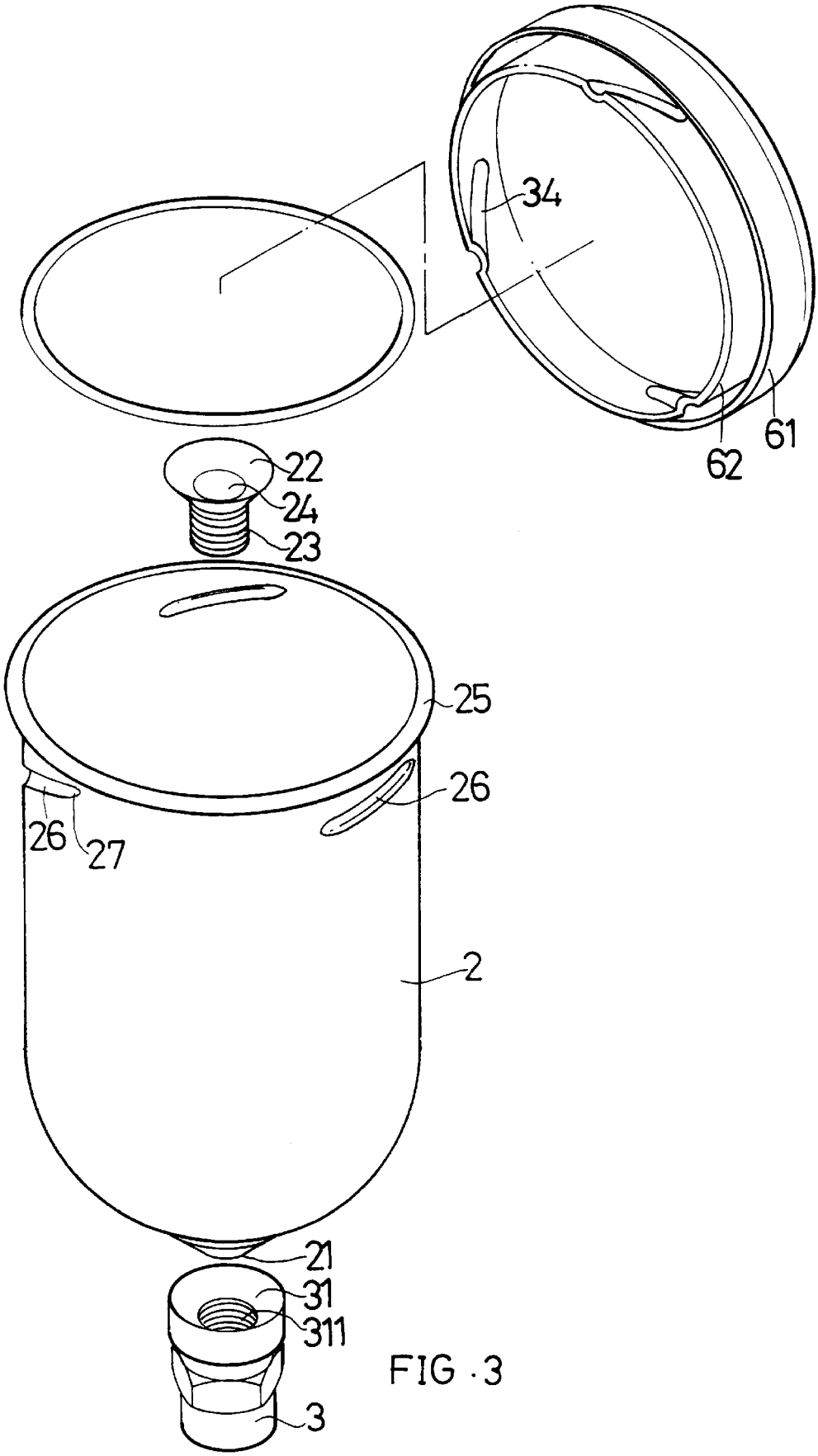
FIG. 3 is a perspective exploded view of a second embodiment of the present invention.
Figure 4:
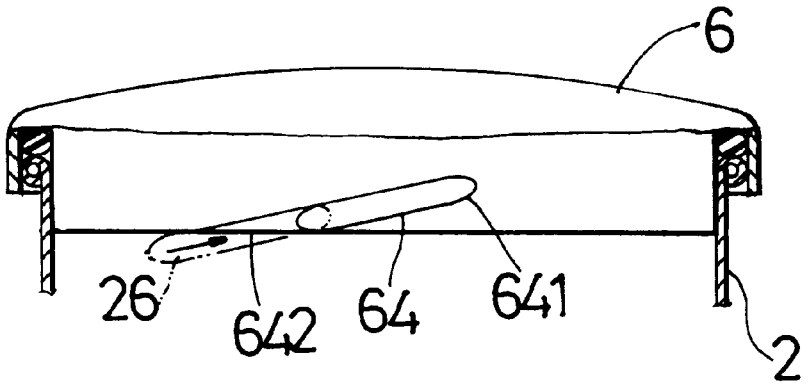
FIG. 4 is a sectional view of the second embodiment of the present invention, showing the operation thereof.
Figure 5:
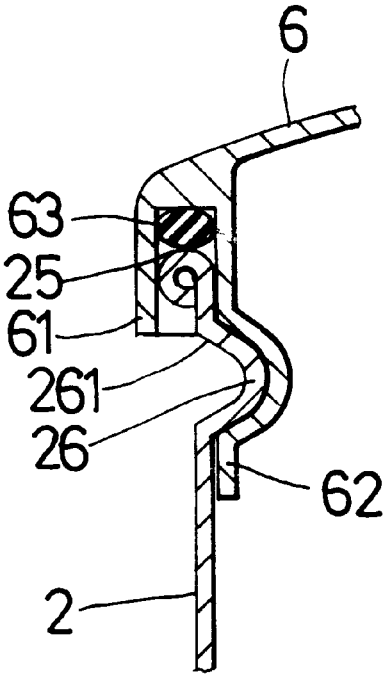
FIG. 5 is a sectional assembled view of a part of the second embodiment of the present invention.
Figure 6:
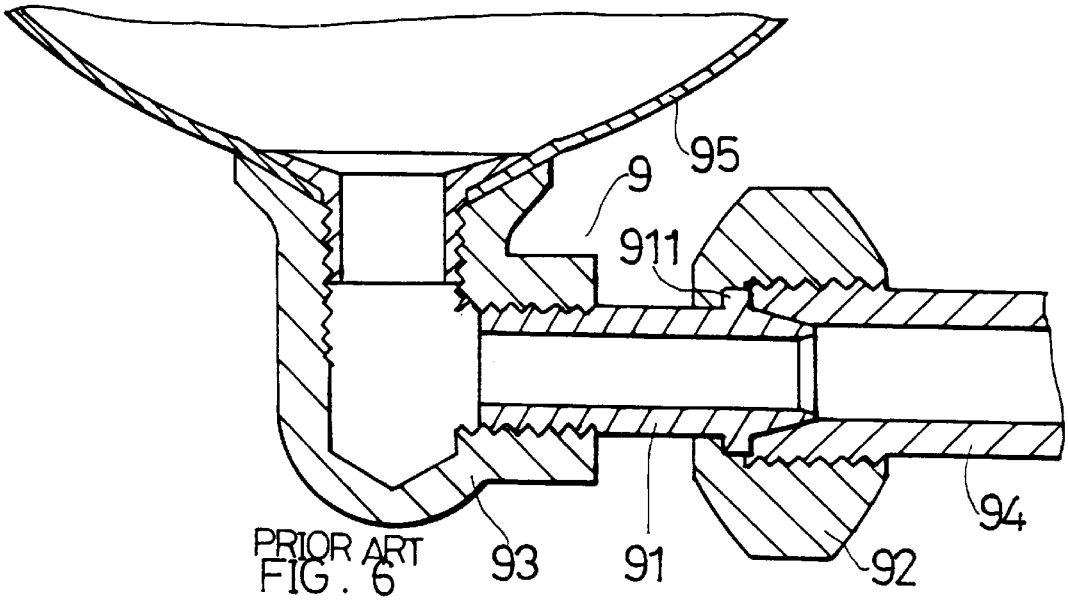
PRIOR ART FIG. 6
FIG. 6 is a sectional assembled view of a conventional spray gun cup structure.
Figure 7:
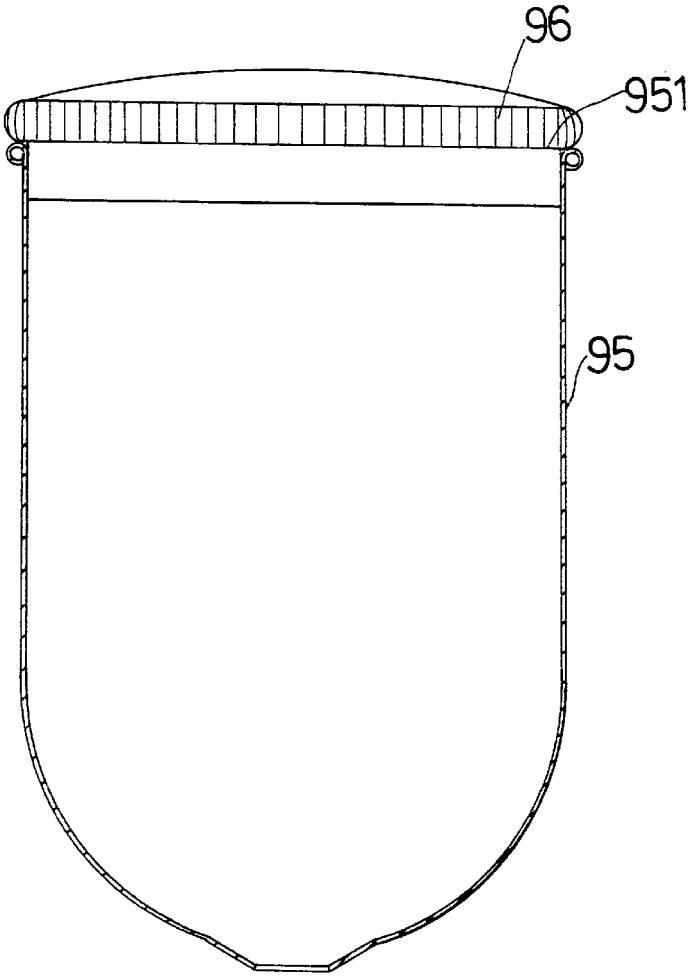
PRIOR ART FIG. 7
FIG. 7 is an assembled view of the cover body of the conventional spray gun cup structure.

FIGS. 3 to 5 show another embodiment of the present invention, in which the top end of the cup 2 is formed with an outward bent flange 25. Multiple inclined ribs 26 are evenly arranged along the circumference of the cup 2 under the flange 25. Each rib 26 has two slope faces 261 inward projecting toward the interior of the cup 2. Each end of the rib 26 is formed with a tapered guide section 27 extending from the two slope faces 261.

A cover body 6 is fitted with the top end of the cup 2. The cover body 6 has a large diameter section 61 and a small diameter section 62 between which a contact section 63 is disposed. The small diameter section 62 is disposed with multiple inward projecting connecting sections 64 corresponding to and engaging with the ribs 26 of the cup 2. A tapered sealing section 641 extends from the top end of the connecting section 64. In addition, the connecting section 64 has an open end 642 at the bottom end of the cover body 6. The cover body 6 is such fitted with the cup 2 that the guide section 27 of the cup 2 is inserted into the open end 642 with the rib 26 tightly attaching to the connecting section 64 until the guide section 27 attaches to the sealing section 641. Accordingly, the more the cover body 3 is rotated, the more tightly the cover body 3 is fitted with the cup 2 and the more tightly the flange 25 of the cup 2 attaches to the contact section 63 as shown in FIG. 5. This effectively prevents the paint material from leaking outside.

As shown in FIG. 4, by means of the engagement between the ribs 26 and the connecting sections 64, a user only needs to rotate the cover body 6 by a certain angle so as to separate the ribs 26 from the connecting sections 64. Moreover, even in the case that the cover body 6 is adhered to the cup 2 by the paint material, the force for rotating the cover body 6 will directly shear the adhering section so that the cover body 6 can be opened by less strength.

According to the above arrangement, the reception section 22 is engaged with the guide member 4 so that the cup 2 can be only normally rotated without rotating and loosening other parts. Therefore, the cup 2 is prevented from loosening and tilting and thus the leakage is avoided. In addition, the ribs 26 of the cup 2 are able to tight fit with the connecting sections 64 of the cover body 6. Only by means of rotating the cover body 6 by a certain angle, the ribs 26 can be separated from or inserted with the connecting sections 64 so as to open or close the cover body 6. In addition, the cover body 6 can be rotated to tightly fit with the cup 2 to achieve a firm association effect without leakage.

The above embodiments are only used to illustrate the present invention, not intended to limit the scope thereof. Many modifications of the above embodiments can be made without departing from the spirit of the present invention.

What is claimed is:

1. An industrial spray gun cup structure comprising:

a cup a bottom end of which is formed with a material outlet disposed with a reception section, one end of the reception section being fixedly connected with the cup, while the other end thereof being formed with a thread section, the reception section being formed with a hole communicating with an interior of the cup;

a connector formed with a hole two ends of which are respectively formed with two thread sections, one of the thread sections being screwed with the thread section of the reception section;

a guide member one end of which is formed with a thread section screwed with the other thread section of the connector, the other end of the guide member being formed with a tapered conic section having an annular flange, the guide member being formed with a hole communicating with the hole of the reception section; and a collar an outer face of which is formed with over one grip section, an inner wall of the collar being formed with a large diameter section and a small diameter section, the large diameter section being coupled with the flange of the guide member, the small diameter section embracing the connecting section of the guide member with the collar, the collar being connected with a spray gun;

wherein the guide member is inserted with the reception section, preventing the reception section and the guide member from rotating relative to each other.

2. An industrial spray gun cup structure as claimed in claim 1, wherein one end of the guide member is formed with a notch in which the reception section is inserted.

3. An industrial spray gun cup structure comprising:

a cylindrical cup for containing therein a paint material, multiple inclined ribs being evenly integrally arranged along a circumference of the cup, each rib having two slope faces inward projecting toward an interior of the cup, each end of the rib being formed with a tapered guide section extending from the slope faces, a bottom end of the cup being disposed with a material outlet;

a cover body fitted with the top end of the cup, the cover body having a large diameter section and a small diameter section, the small diameter section being disposed with multiple inward projecting connecting sections corresponding to and engaging with the ribs of the cup, a tapered sealing section extending from the top end of the connecting section, the connecting section having an open end at the bottom end of the cover body, the guide section of the cup being inserted into the open end with the rib tightly attaching to the connecting section until the guide section attaches to the sealing section so as to associate the cup with the cover body.

4. An industrial spray gun cup structure as claimed in claim 3, wherein the top end of the cup is formed with an outward bent flange attaching to a contact section between the large diameter section and small diameter section of the cover body.

* * * * *